US009890556B2

(12) United States Patent
Fink et al.

(10) Patent No.: US 9,890,556 B2
(45) Date of Patent: Feb. 13, 2018

(54) LEVER ACTION SECURITY HANDLE

(71) Applicant: FATH, INC., Orlando, FL (US)

(72) Inventors: Armin Fink, Ocoee, FL (US); William Kenneth Williams, Orlando, FL (US)

(73) Assignee: FATH, INC., Orlando, FL (US)

( * ) Notice: Subject to any disclaimer, the term of this patent is extended or adjusted under 35 U.S.C. 154(b) by 0 days.

(21) Appl. No.: 15/611,256

(22) Filed: Jun. 1, 2017

(65) Prior Publication Data

US 2017/0350161 A1 Dec. 7, 2017

Related U.S. Application Data

(60) Provisional application No. 62/346,700, filed on Jun. 7, 2016.

(51) Int. Cl.

| | |
|---|---|
| ***E05B 13/10*** | (2006.01) |
| ***E05B 1/00*** | (2006.01) |
| ***E05B 15/02*** | (2006.01) |
| ***E05C 3/16*** | (2006.01) |
| ***E05B 65/00*** | (2006.01) |

(52) U.S. Cl.

CPC ..... *E05B 13/106* (2013.01); *E05B 1/003* (2013.01); *E05B 15/02* (2013.01); *E05B 65/006* (2013.01); *E05C 3/16* (2013.01)

(58) Field of Classification Search

CPC ..... E05B 13/106; E05B 65/006; E05B 1/003; E05B 15/02; E05C 3/16; E05C 3/162; E05C 3/167

USPC ..... 70/190, 191, 208, 210, 215, 224, 462; 292/51, 112, 142, 160, 199, 200, 244, 292/336.3, DIG. 31

See application file for complete search history.

(56) References Cited

U.S. PATENT DOCUMENTS

| | | | | | |
|---|---|---|---|---|---|
| 256,637 | A | * | 4/1882 | Campbell et al. | E05B 17/0029 292/199 |
| 676,779 | A | * | 6/1901 | Stahl | E05B 17/0029 292/199 |
| 708,097 | A | * | 9/1902 | Tower | E05B 17/0029 292/199 |
| 2,934,370 | A | * | 4/1960 | Love | E05C 1/065 292/142 |
| 4,982,303 | A | * | 1/1991 | Krenz | G11B 31/00 292/199 |
| 5,722,269 | A | * | 3/1998 | Simon | E05B 13/10 292/336.3 |
| 5,970,757 | A | * | 10/1999 | Ramsauer | E05B 13/10 292/336.3 |

(Continued)

*Primary Examiner* — Lloyd Gall

(74) *Attorney, Agent, or Firm* — Robert L. Wolter; Beusse, Wolter, Sanks & Maire PLLC

(57) ABSTRACT

A handle (100), having: an escutcheon (106) having a recessed area (300); a lever (104) pivotally mounted toward the top end of the escutcheon and at least a portion of the lever is disposed within the recessed area when in a lever closed position (102); a first gear (310) operatively connected to a top side (312) of the lever and a portion of the first gear including gear teeth (320) extending through an opening (360) in the escutcheon; a second gear (324) mounted on a back (130) of the escutcheon and having cam teeth (322) that mesh with the gear teeth of the first gear; a cam latch (140) operatively connected to the second gear to rotate when the second gear rotates; and, a lock assembly (146) mounted to a bottom end (202) of the lever.

18 Claims, 13 Drawing Sheets

(56) References Cited

U.S. PATENT DOCUMENTS

| | | | | |
|---|---|---|---|---|
| 6,182,483 | B1 * | 2/2001 | von Kathen | E05B 1/0092 292/336.3 |
| 6,354,639 | B1 * | 3/2002 | Minter | E05C 9/021 292/142 |
| 6,363,761 | B1 * | 4/2002 | Sauerland | E05B 13/002 292/336.3 |
| 6,685,240 | B2 * | 2/2004 | Bacon | E05B 85/18 292/142 |
| 7,255,375 | B2 * | 8/2007 | Heid | E05B 15/0006 292/112 |
| 7,422,249 | B2 * | 9/2008 | Glover | E05B 65/0811 292/199 |
| 7,451,628 | B1 * | 11/2008 | Kim | E05B 83/30 292/142 |
| 8,016,329 | B2 * | 9/2011 | Johansson | E05B 13/002 292/108 |
| 8,882,162 | B2 * | 11/2014 | Uyeda | E05B 59/00 292/172 |
| 2002/0036409 | A1 * | 3/2002 | Lambertz | E05B 77/42 292/336.3 |
| 2002/0121786 | A1 * | 9/2002 | Meinke | E05B 85/107 292/347 |
| 2005/0280266 | A1 * | 12/2005 | Mueller | E05B 77/06 292/336.3 |
| 2010/0327612 | A1 * | 12/2010 | Liebel | E05B 7/00 292/336.3 |
| 2011/0254658 | A1 * | 10/2011 | Hui | E05B 7/00 340/5.2 |
| 2014/0260458 | A1 * | 9/2014 | Lee | E05B 7/00 70/344 |

* cited by examiner

LEVER ACTION SECURITY HANDLE

BACKGROUND OF THE INVENTION

The present invention relates to security handle assemblies. More specifically, the invention relates to security handle assemblies that open in a single motion.

Most of the security swing handle assemblies include a housing mounted to an enclosure door. The housing has a recess over which a swing lever, pivotally mounted to the housing, is retained in a closed position. A hasp mounted in the recess extends through an opening in the lever to receive a padlock for locking the lever in the closed position. In order to open the enclosure door, the padlock is removed and a tool is inserted into a key plug and rotated releasing the lever to an open position. The lever, which is operatively connected to a door latch mechanism in the interior of the cabinet enclosure, is manually pivoted to open the door.

Such security swing handle assemblies are used on electrical enclosure doors of electrical enclosures for cell phone towers. Unfortunately, thieves often break into these electrical enclosures to steal copper wiring which can also result in damage to electrical component in the enclosures. The problem with these existing security swing handle assemblies is that thieves smash the padlock with a large implement to break the padlock from the assembly. In doing so, the hasp and lever are broken so the thieves are then able to access the enclosures. Even if the hasp and lever are not broken from the assembly, the thief will still be able to open the lever by using a tool, which can be found at virtually any hardware store, to insert into the key plug and rotate it to release the lever to the open position. Accordingly, a need exists for an improved security swing handle assembly.

BRIEF DESCRIPTION OF THE DRAWINGS

The invention is explained in the following description in view of the drawings that show.

DETAILED DESCRIPTION OF THE INVENTION

The present inventors have devised an innovative security handle assembly ("handle") that provides several advantages over the prior art handle assemblies. The handle provides single action locking and unlocking of the electrical panel door. Specifically, in a closed position the handle secures the panel door in a respective closed position. A lever can be locked into the closed position via a locking assembly. In one opening motion from the closed position to the open position the lever unlocks the panel door and enables the user to open the panel door. Likewise, in one closing motion from the open position to the closed position the lever enables the user to close the panel door and the lever then locks the closed panel door. This eliminates any rotation associated with prior art levers and any guesswork about which way to rotate the lever. In addition, when closed the lever is fully surrounded by an escutcheon, thereby mitigating any snag hazard it poses.

Figure 1:
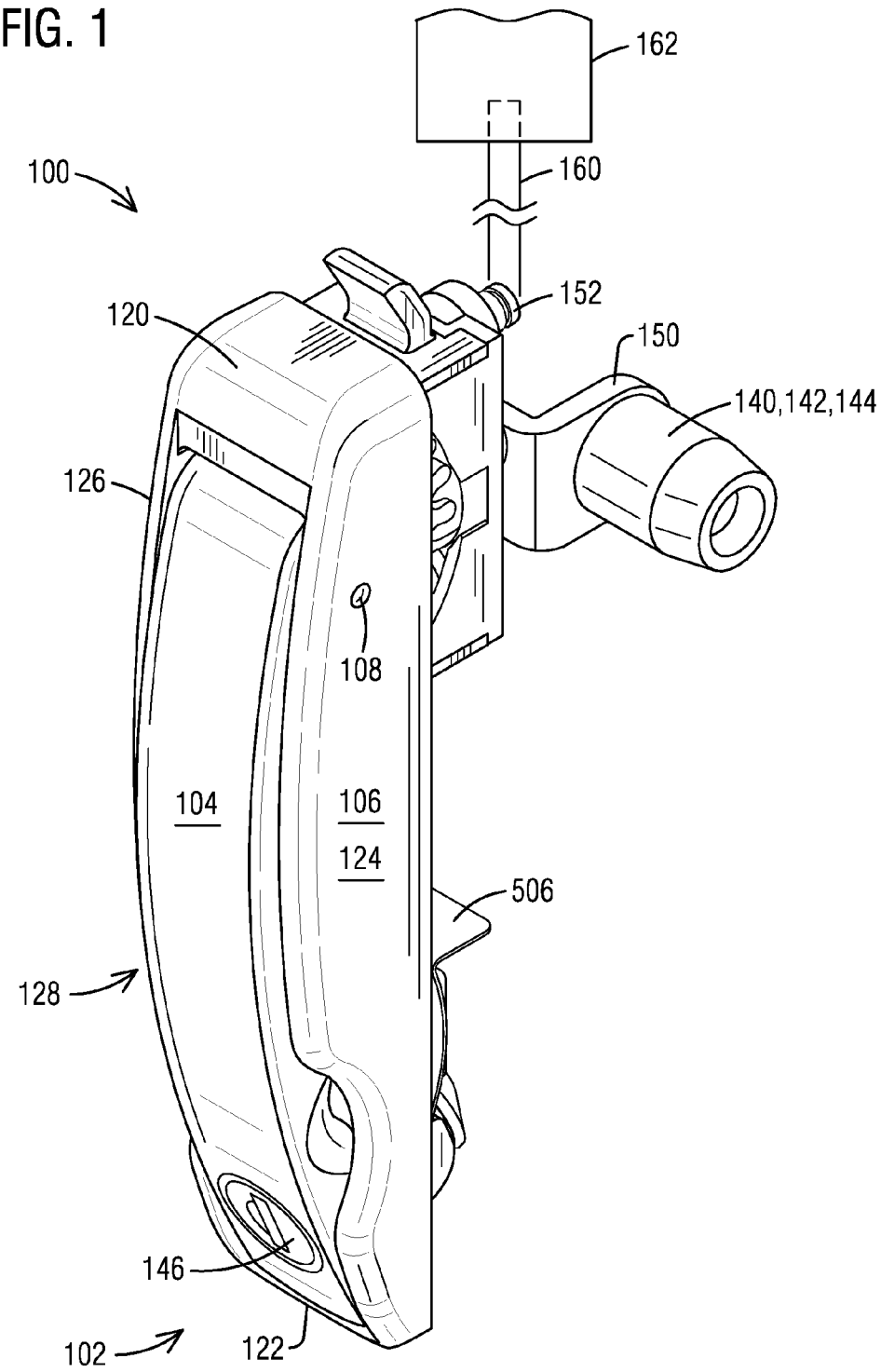
FIG. 1 is a perspective view of an example embodiment of the handle in a closed position.

FIG. 1 is a perspective view of an example embodiment of the handle 100 in a lever closed position 102. The handle 100 includes a lever 104 pivotally mounted to an escutcheon 106 at a lever pivot 108. The escutcheon 106 includes a top end 120, a bottom end 122, a first side wall 124, a second side wall 126, a front 128, and a back 130. In the example embodiment shown, the first side wall 124 and the second side wall 126 are parallel, but this is not mandatory. In the lever closed position 102, a cam latch 140 is in a cam closed position 142 via a cam surface 144 that locks the handle 100 to the panel door (not shown). The handle 100 optionally includes a lock assembly 146 that locks the lever 104 into the lever closed position 102.

In the example embodiment shown, the cam latch 140 is part of a rotating structure 150. The rotating structure 150 further includes a first stud 152 and a second stud 154 (visible in FIG. 2). In an example embodiment, the first stud 152 and the second stud 154 are connected to another engagement means for securing the panel door in the closed position. For example, the first stud 150 may be secured to an end of a first rod 160 that extends upward (in FIG. 1) and passes through a catch 162 of the door frame (not shown). In such a configuration, when the cam latch 140 is in the closed position 142, the first stud 152 holds the first rod upward so that the first rod engages the catch 162, thereby holding the panel door in the door frame. Rotating the cam latch 140 to the open position 206 drops the first rod 160, thereby disengaging the first rod 162 from the catch 162 and freeing the panel door to open (as seen in FIG. 2).

Similarly, the second stud 154 may be secured to a second rod (not shown) that extends downward through the panel door and into a respective catch 126 when the cam latch 140 is in the closed position 142. Rotating the cam latch 140 to the open position 206 lifts the second rod, thereby disengaging the second rod from the catch 126, freeing the panel door to open. This is only one of many possible configurations whereby the first stud 152 and the second stud 154 can be used to bolster the security of the panel door.

Figure 2:
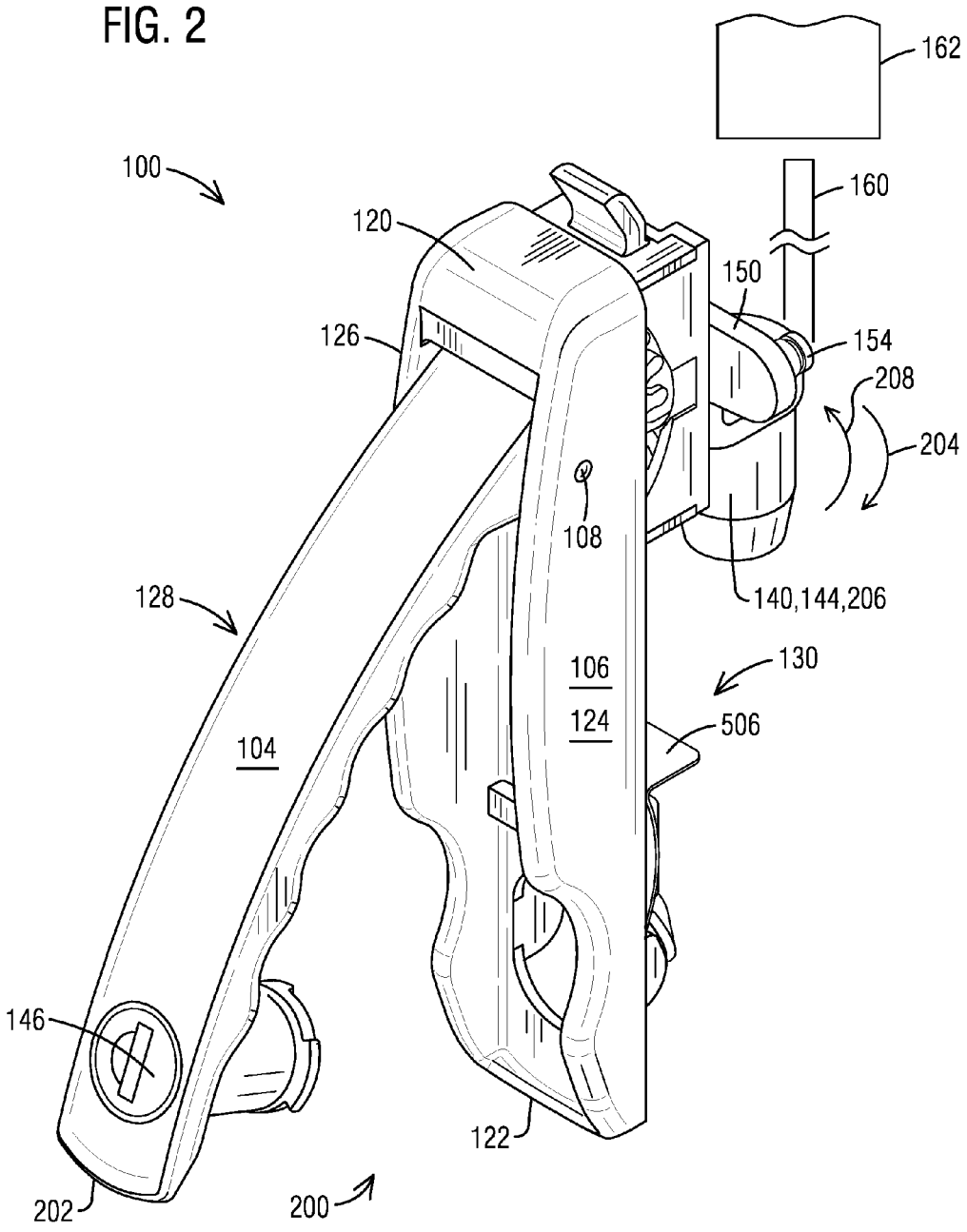
FIG. 2 is a perspective view of the example embodiment of FIG. 1 in the open position.

FIG. 2 is a perspective view of the handle 100 of FIG. 1 in a lever open position 200. Lifting a bottom end 202 of the lever 104 out of the escutcheon 106 rotates the cam latch 140 in direction 204 to a cam open position 206 such that the cam latch 140 disengages from a cam catch in the door frame (not shown) and allows the panel door to open. Continued application of the lifting force serves to open the panel door once the cam latch 140 has disengaged from the panel. Accordingly, one motion unlocks and opens the panel door. From in the lever open position 200, pushing on the bottom end 202 of the lever 104 first closes the panel door. Continued pushing lowers the bottom end 202 of the lever 104, which rotates the cam latch 140 in direction 208 to the cam closed position 142, causing the cam latch 140 to engage the panel and lock the panel door in place.

Figure 3:
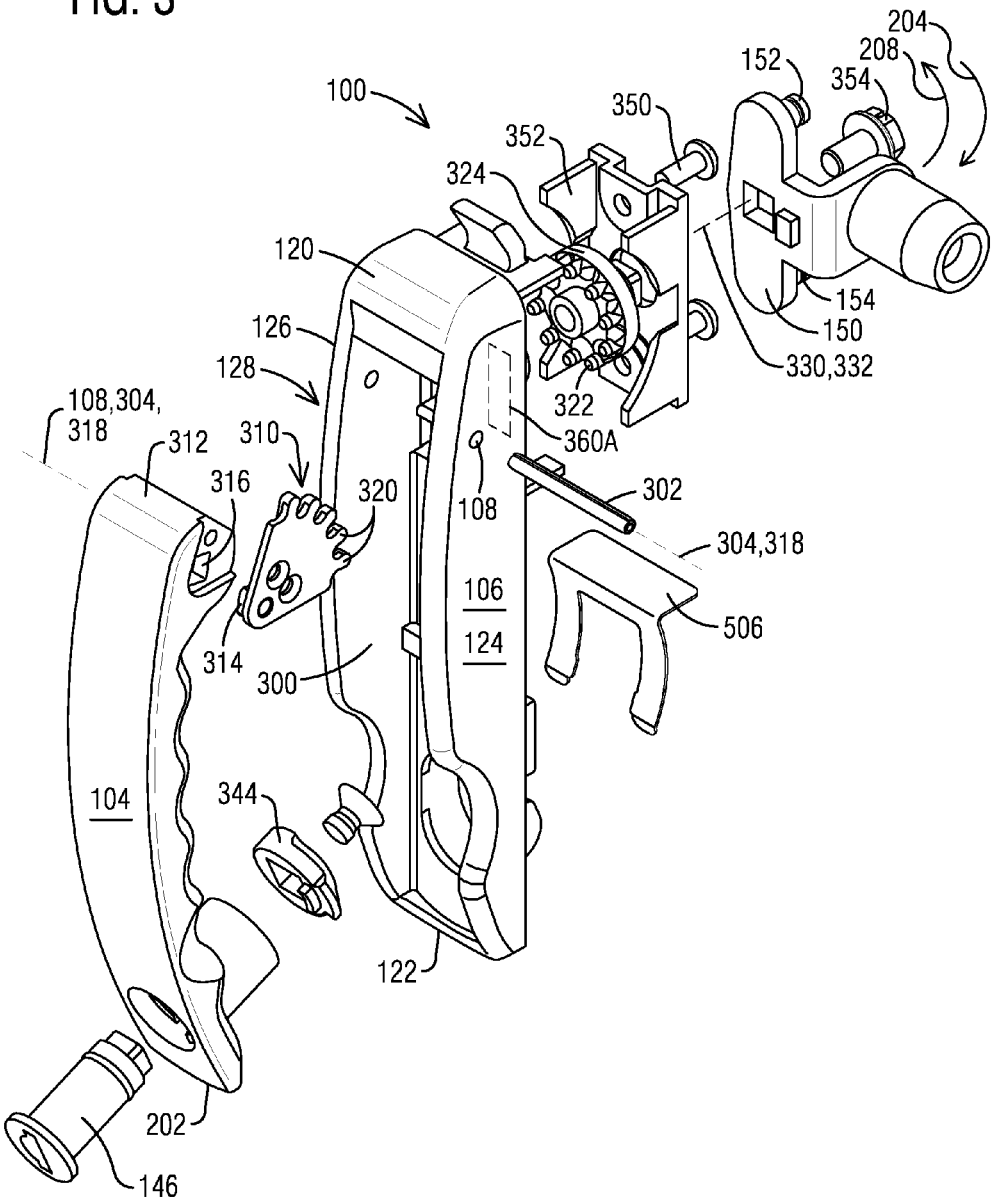
FIG. 3 is an exploded perspective view of the example embodiment of FIG. 1.

FIG. 3 is an exploded perspective view of the example embodiment of FIG. 1. The top end 120, the bottom end 122, the first side wall 124, and the second side wall 126 of the escutcheon 106 define a recessed area 300 inside which at least a portion of the lever 104 resides when in the lever closed position 102. In the example embodiment shown, a majority of the lever 104 is disposed within the recessed area 300. In an example embodiment, a hinge pin 302 defines the lever pivot 108 and a first axis of rotation 304 about which the lever 104 pivots. Rotation of the lever 104 defines a first plane of rotation that is perpendicular to the first axis of rotation 304. (Planes of rotation are visible in FIGS. 4 and 5.)

A main gear drive 310 (i.e. a first gear) is operatively associated with the lever 104 so that the main gear drive 310 moves when the lever 104 moves. In the example embodiment shown, the main gear drive 310 is secured to the hinge pin 302 and to a top end 312 of the lever 104. A main gear interlocking feature 314 and a lever interlocking feature 316 cooperate to ensure there is no relative rotational movement between the lever 104 and the main gear drive 310. As a result, when the lever 104 is rotated the main gear drive 310 rotates about a third axis of rotation 318 and in a third plane of rotation that is perpendicular to the third axis of rotation 318. In the example embodiment shown, the first axis of rotation 304 and the third axis of rotation 318 are the same, and the first rotation plane and the third plane of rotation are parallel to each other.

Gear teeth 320 extending toward and through the back 130 of the escutcheon 106 engage cam teeth 322 and cause cam teeth 322 to rotate when gear teeth 320 rotate. The cam teeth 322 extend toward the front 128 of the escutcheon, transverse to a cam gear 324 (i.e. a second gear), to engage with the gear teeth 320. In the example embodiment shown, the cam teeth 322 extend toward the front 128 of the escutcheon, perpendicular to a cam gear 324, to engage with the gear teeth 320.

Rotating the main drive gear 310 rotates the cam gear 324 about a fourth axis of rotation 330 and the rotation defines a fourth plane of rotation perpendicular to the fourth axis of rotation 330. The cam gear 324 is secured to the cam latch 140 so that rotation of the cam gear 324 rotates the cam latch 140 about a second axis of rotation 332 in directions 204 and 208, where directions 204 and 208 define a second plane of rotation. that is perpendicular to the second axis of rotation 332. In the embodiment shown, the axis of rotation 330 and the second axis of rotation 332 are the same axis. In the example embodiment shown, the fourth plane of rotation and the second plane of rotation are parallel to each other.

The first plane of rotation (of the lever 104 and the second plane of rotation (of the cam latch 140) are transverse to each other. In the example embodiment shown, the first plane of rotation and the second plane of rotation are perpendicular to each other. In this way, moving the lever 104 between the lever closed position 102 and the lever open position 200 in one plane is effective to rotate the cam latch 140 between the cam closed position 142 and the cam open position 206 in a transverse plane, even when the transverse plane is perpendicular to the one plane. Consequently, there is no need to rotate the lever 104 to release the panel door from the panel; the panel door releases with a single movement.

The lock assembly 146 secured the lever 104 in the lever closed position 102. In this example embodiment, the lock assembly 146 fits into a lock recess 340. A lock element 342, shown in a locked orientation 344, engages the escutcheon 106, thereby locking the bottom end 202 of the lever 104 into the escutcheon 106. To unlock the lock assembly 146, a key (not shown) rotates the lock element 342 so that the lock element 342 no longer engages the escutcheon 106, thereby freeing the bottom end 202.

In the example embodiment shown, cam cover fasteners 350 secure a cam cover 352 over the cam gear 324. A cam retention fastener 354 secures the cam latch 140 to the cam gear 324. The cam teeth 324 extend through opening 360A in the back 130 of the escutcheon.

Figure 4:
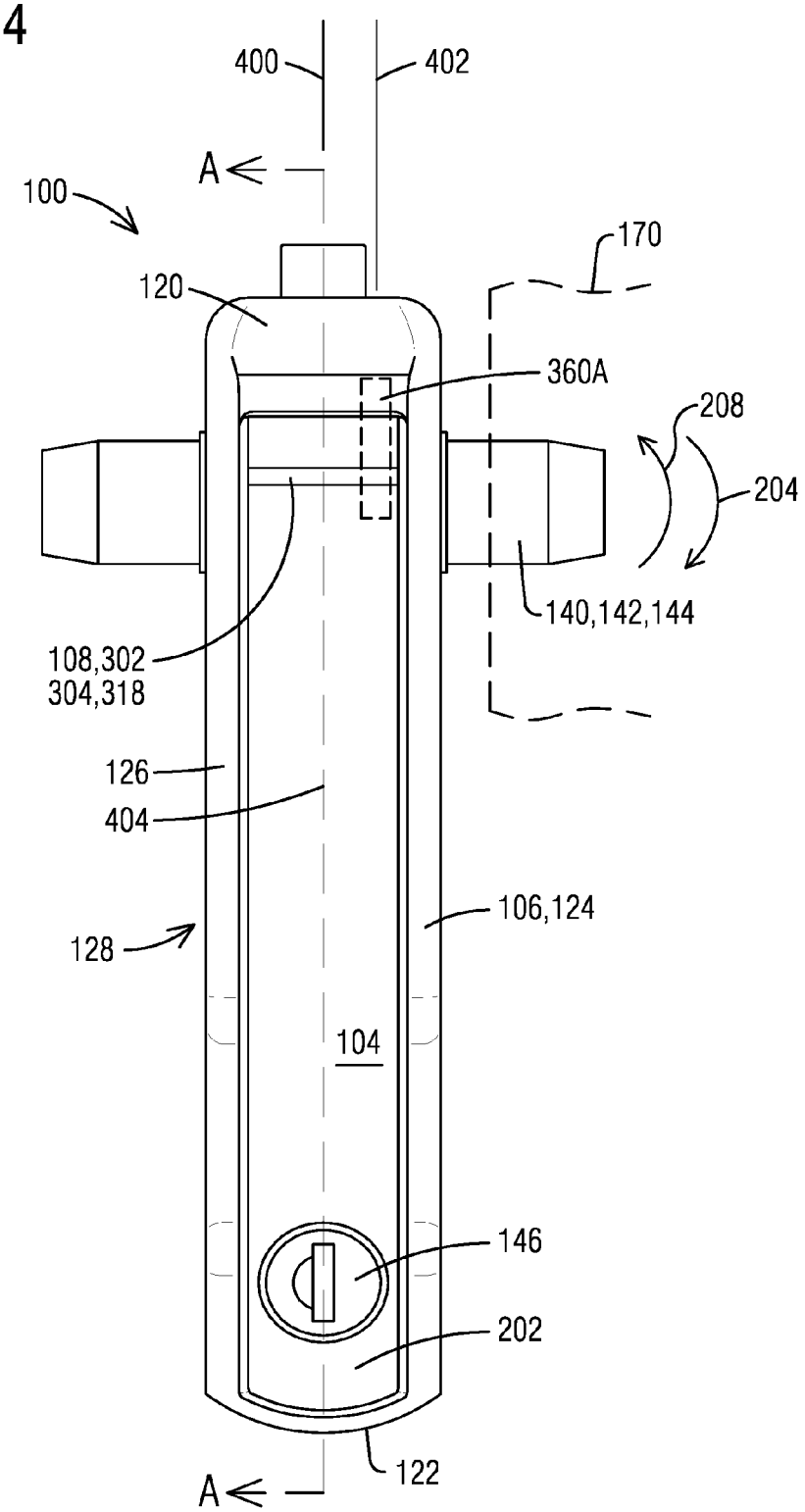
FIG. 4 is a front view of the example embodiment of FIG. 1.

FIG. 4 is a front view of the handle 100 of FIG. 1. Visible are the first plane of rotation 400 in which, for example, a longitudinal axis 404 of the lever 104 rotates, and the third plane of rotation 402 in which, for example, a point of a gear tooth 320 of the main drive gear 310 rotates. Also visible is a cam catch 170 that is part of the door frame (not shown) and against which the cam latch 140 rests when the lever is in the closed position 102. This interaction locks the door panel in place in the door frame.

Figure 5:
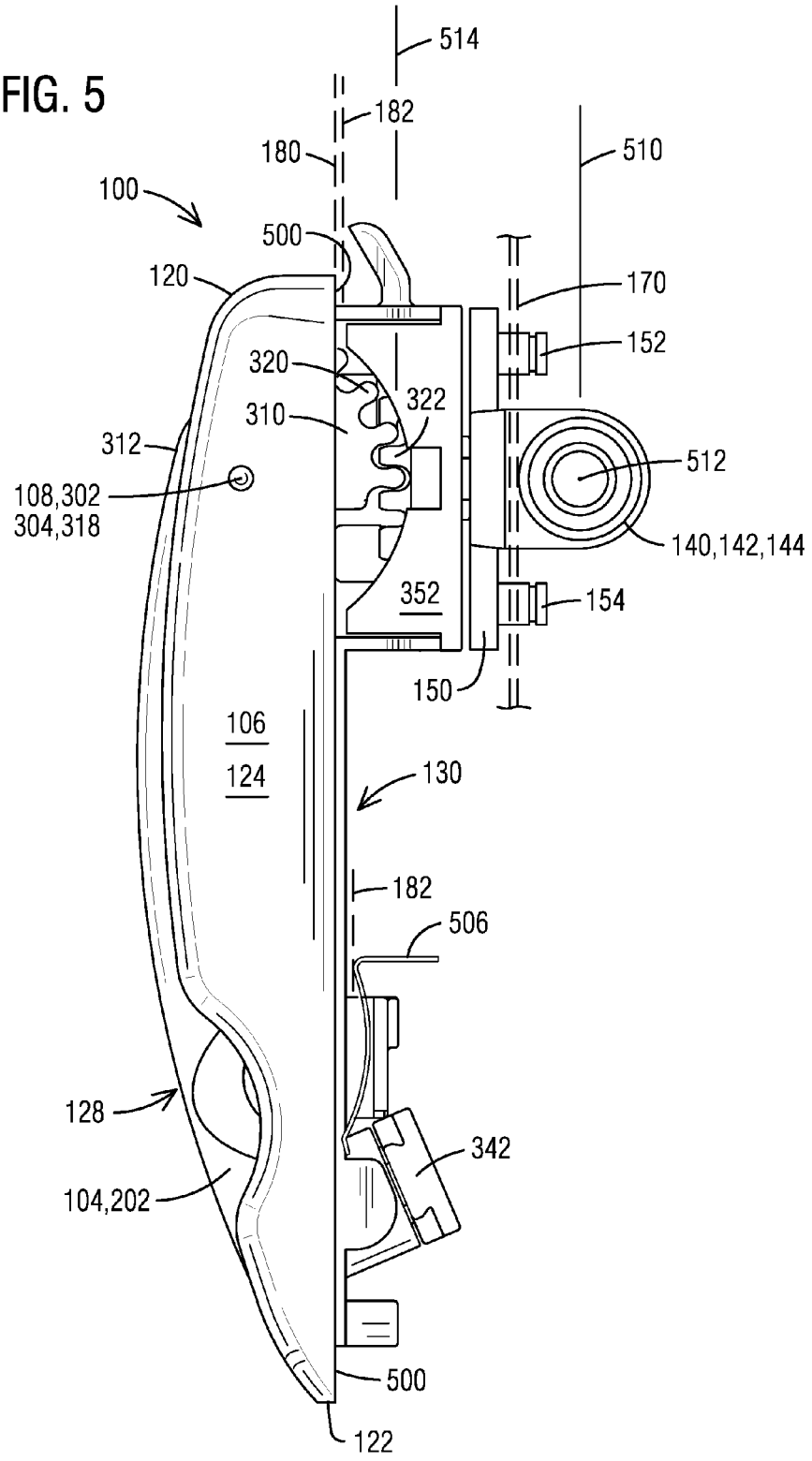
FIG. 5 is a side view of the example embodiment of FIG. 1.

FIG. 5 is a side view of the handle 100 of FIG. 1. To install the handle 100, the back 130 is inserted through a slot (not shown) in a panel such that a surface 500 of the handle 100 rests on an outside surface 180 of the panel 182. The cam cover 352 over the gears as well as the lock assembly 146 protrude into the panel. An upper retainer 504 and a lower retaining clip 506 sandwich and hold the panel 182 between the surface 500 and the upper retainer 504 and a lower retaining clip 506. In this example embodiment, no tools are needed to install the handle 100.

Visible are the second plane of rotation 510 in which, for example, a longitudinal axis 512 the cam latch 140 rotates, and the fourth plane of rotation 514 in which, for example, a point of a cam tooth 322 of the cam gear 324 rotates.

Figure 6:
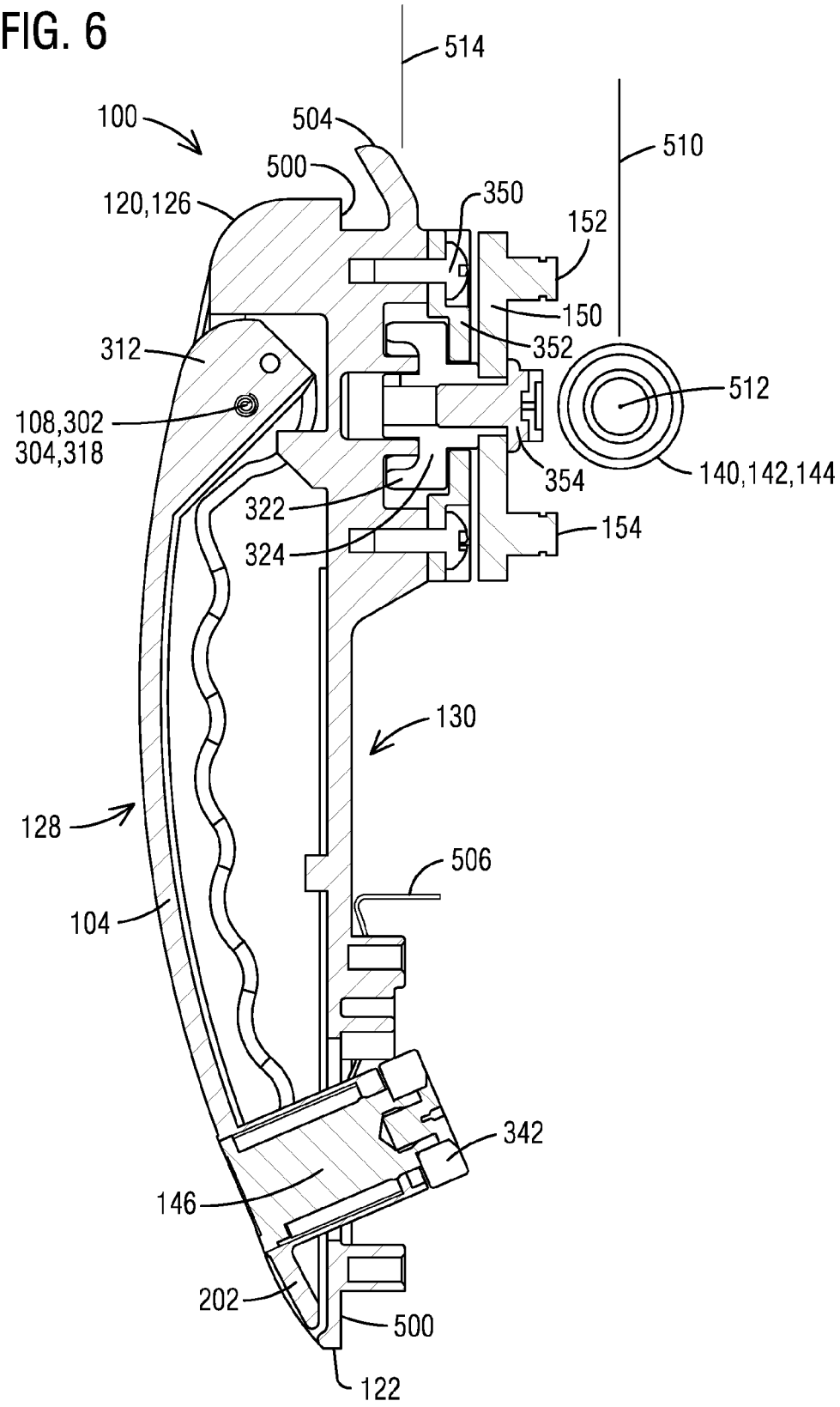
FIG. 6 is a sectional side view along line A-A of the example embodiment of FIG. 4.
Figure 7:
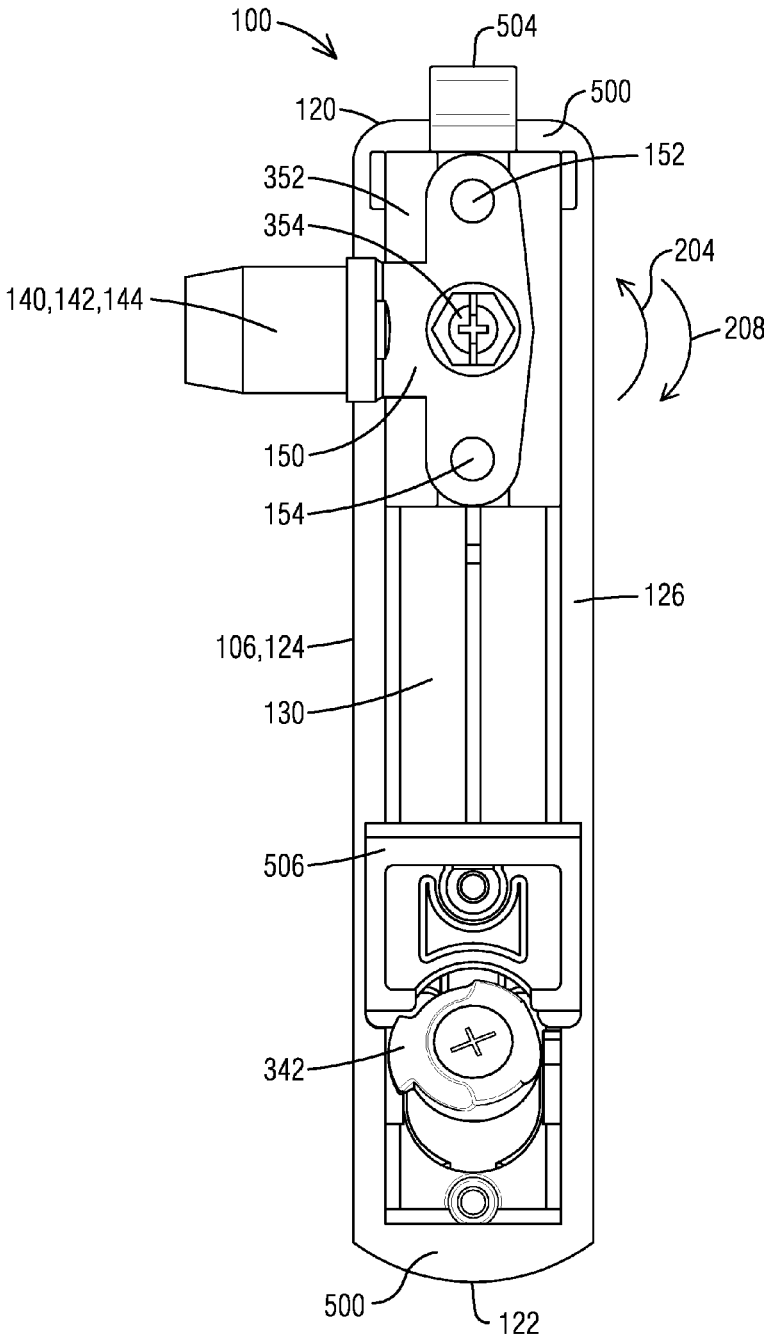
FIG. 7 is a rear view of the example embodiment of FIG. 1.

FIG. 6 is a sectional side view along line A-A of the handle 100 of FIG. 4. FIG. 7 is a rear view of the handle 100 of FIG. 1.

Figure 8:
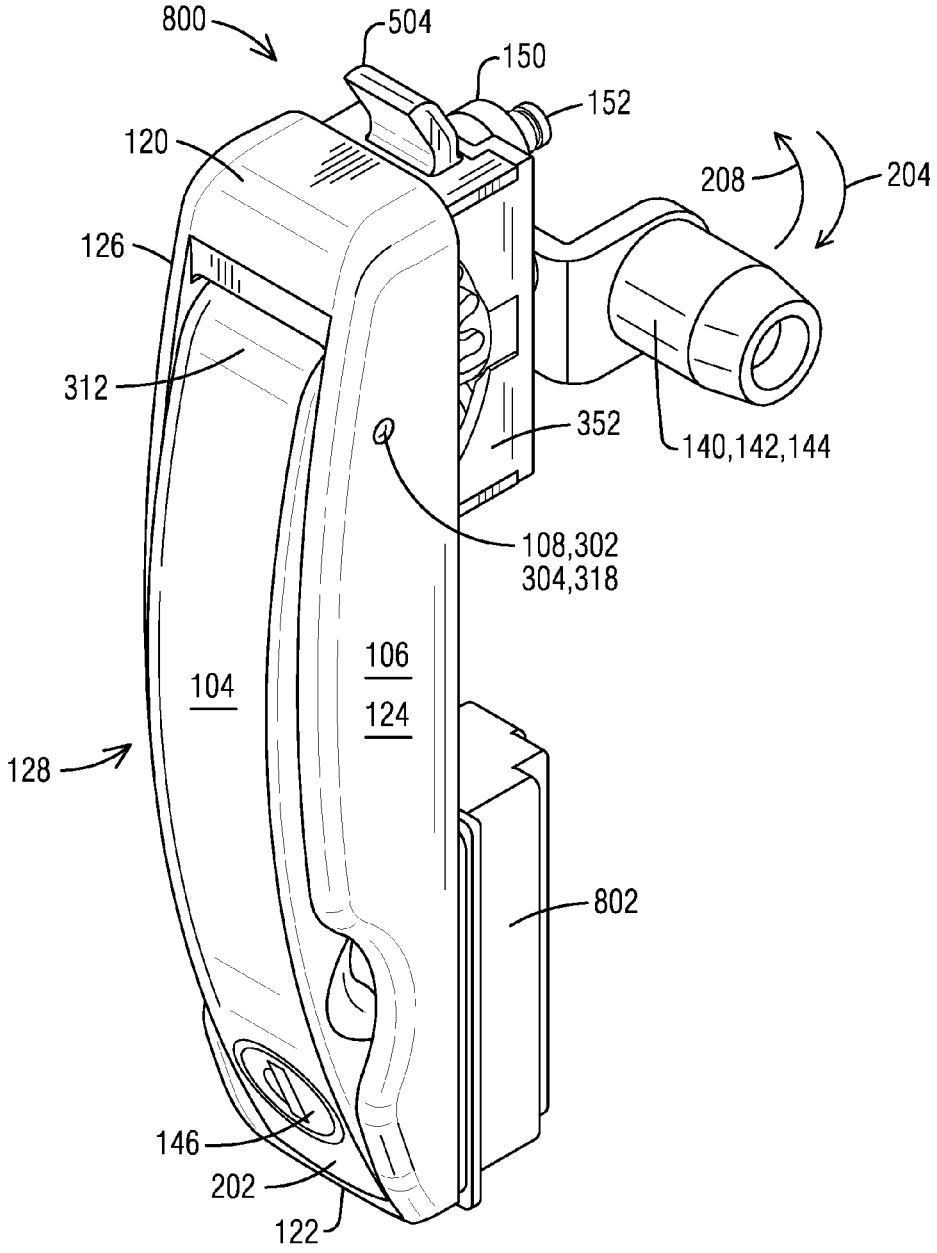
FIG. 8 is a perspective view of an alternate example embodiment of the handle in the closed position.

FIG. 8 is a perspective view of an alternate example embodiment of the handle 800 in the closed position. In this example embodiment, the lower retaining clip 506 of FIG. 5 is replaced with a lock cover 802 that covers the lock assembly 146 and sandwiches the panel door.

Figure 9:
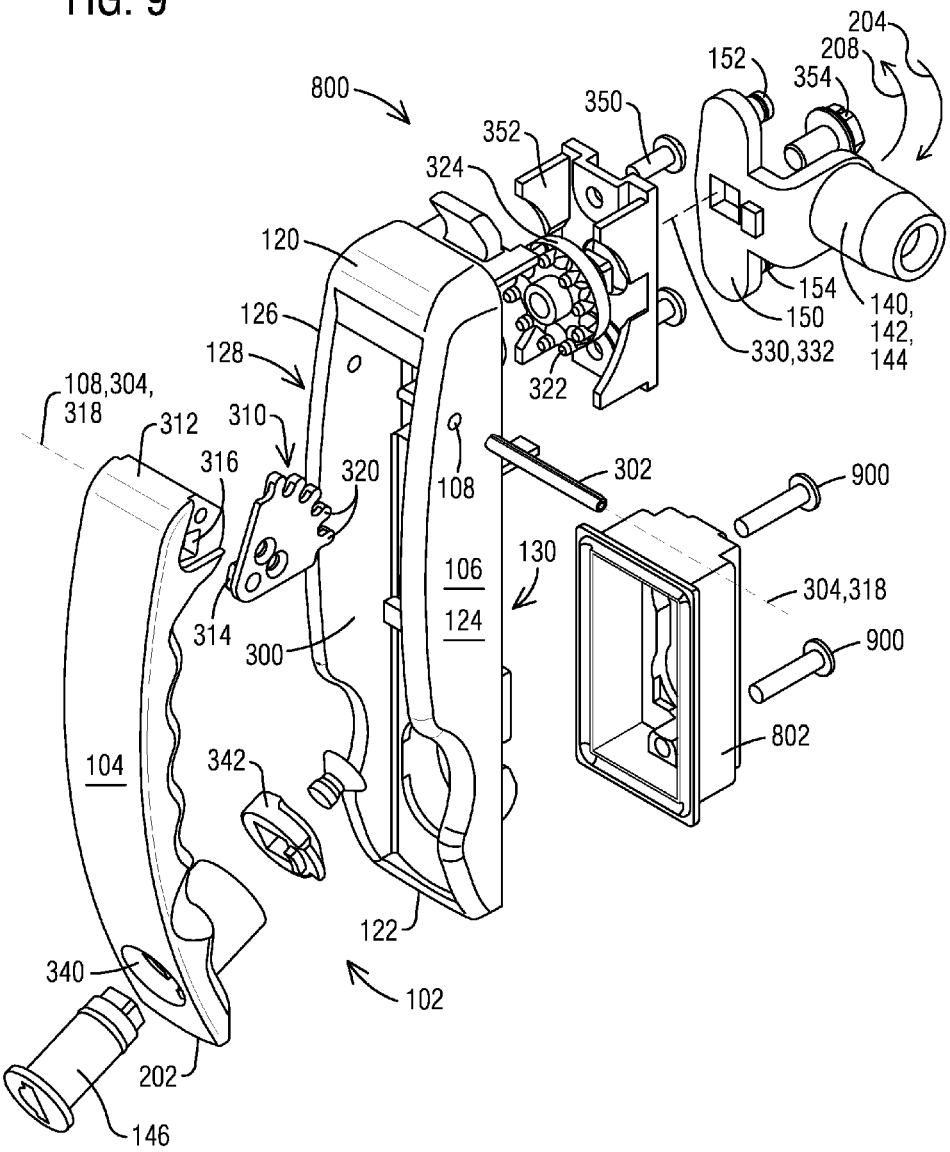
FIG. 9 is an exploded perspective view of the example embodiment of FIG. 8
Figure 10:
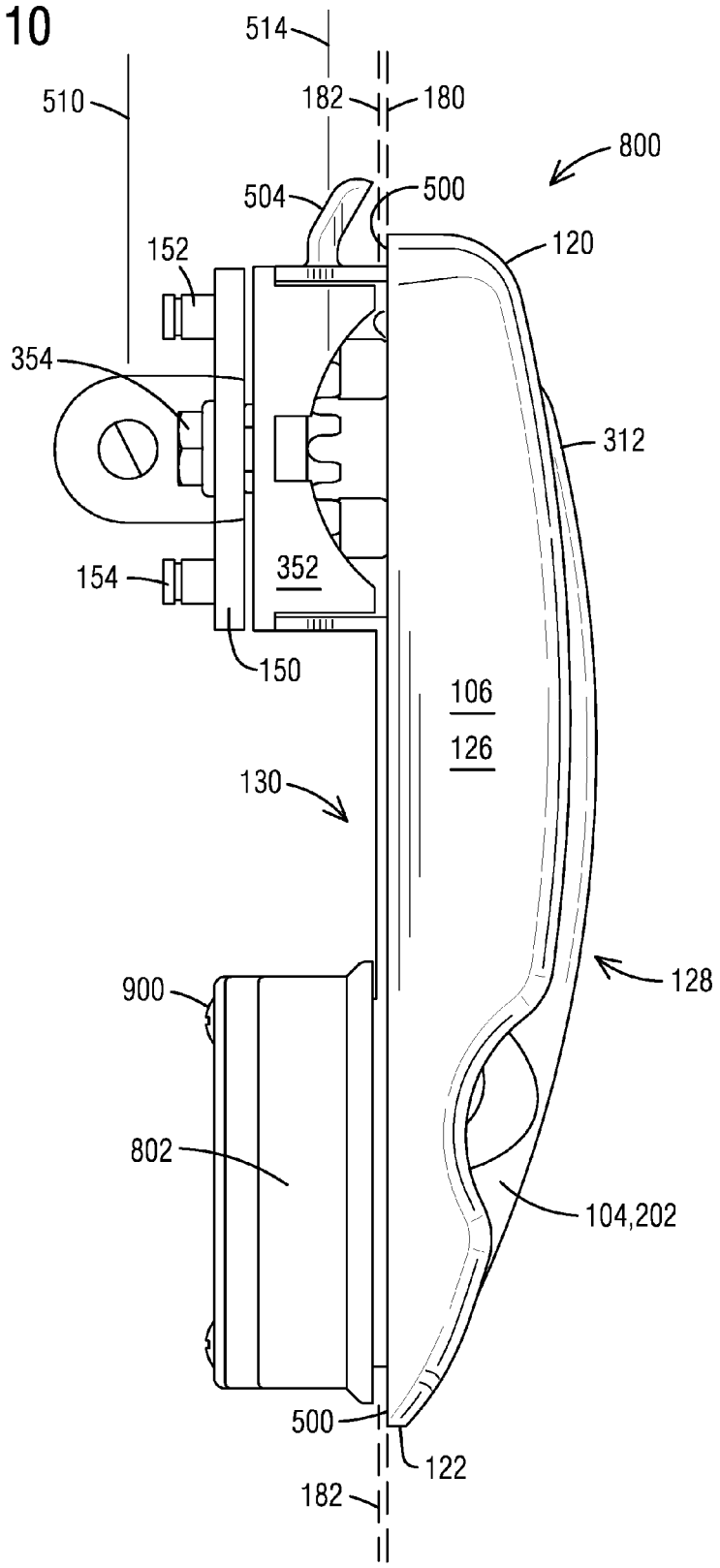
FIG. 10 is a side view of the example embodiment of FIG. 8.
Figure 11:
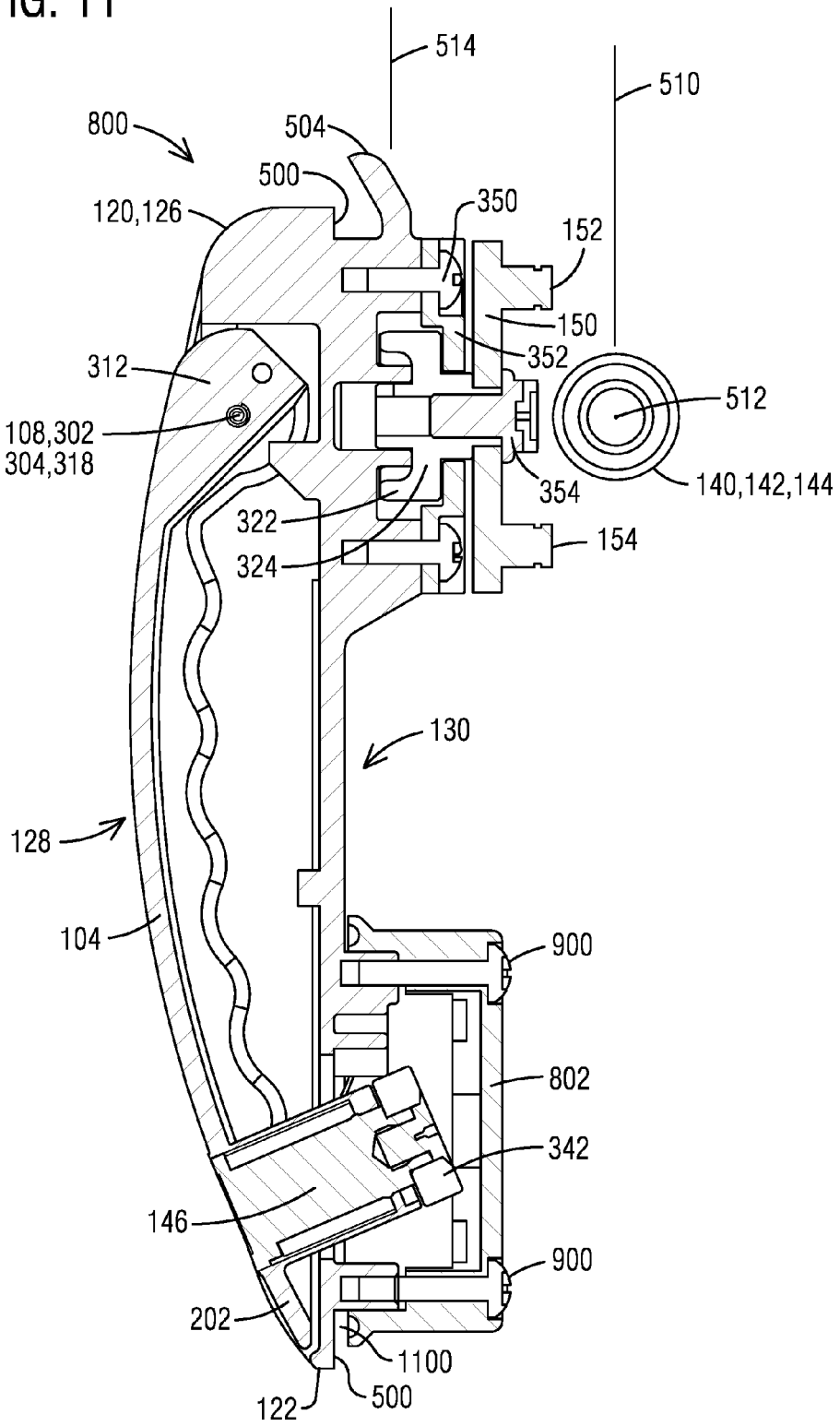
FIG. 11 is a sectional side view of the alternate example embodiment of FIG. 9.
Figure 12:
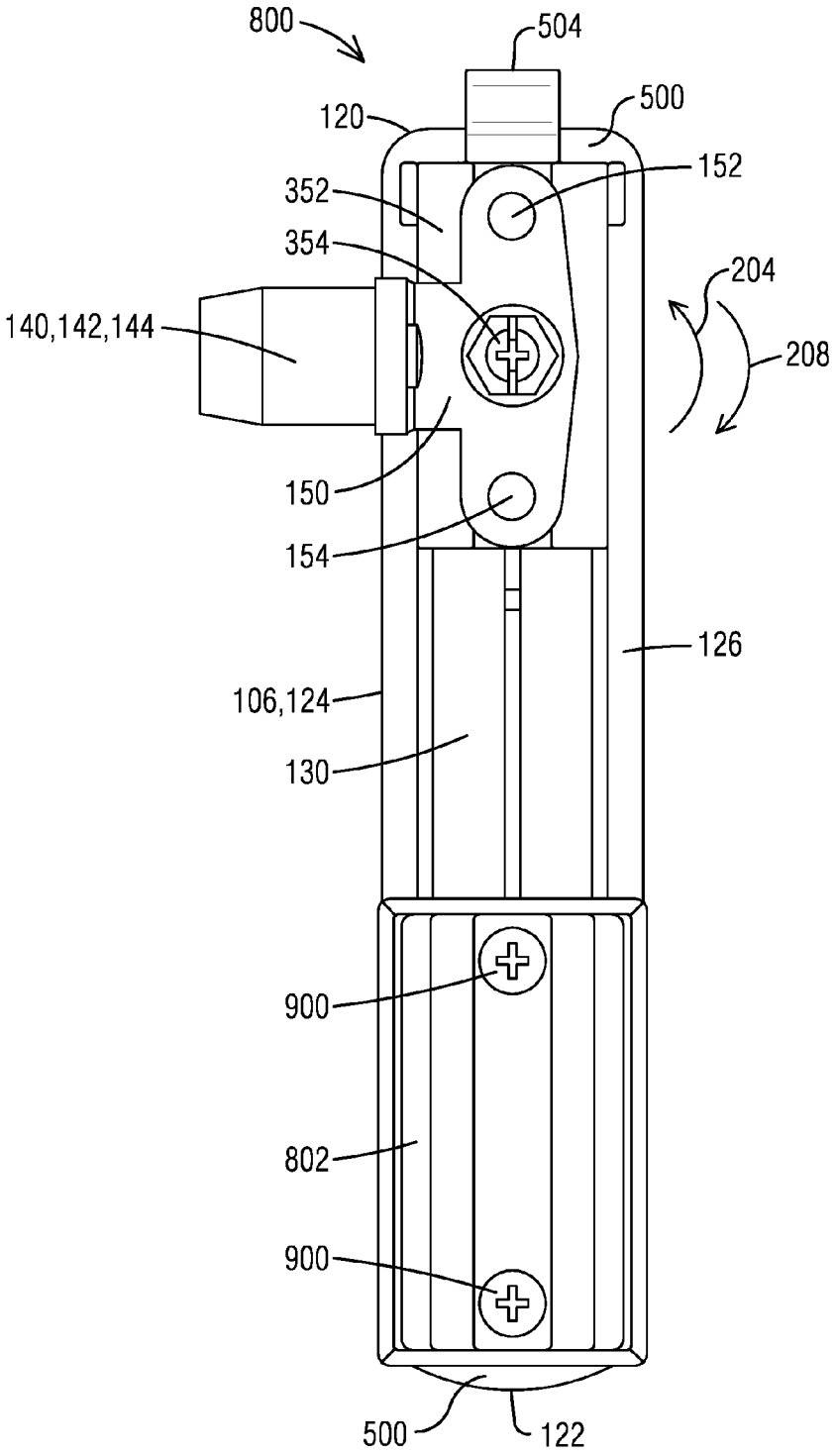
FIG. 12 is rear view of the alternate example embodiment of FIG. 8.

FIG. 9 is an exploded perspective view of the example embodiment of the handle 800 of FIG. 8. Here it can be seen that lock cover fasteners 900 secure the lock cover 802 in position, thereby also sandwiching the panel door between the lock cover and the surface 500. FIG. 10 is a side view of the example embodiment of the handle 800 of FIG. 8. FIG. 11 is a sectional side view of the handle 800 of FIG. 8. A gap 1100 is formed between the surface 500 and the lock cover 802 in which the panel door is sandwiched when the handle 800 is installed. FIG. 12 is rear view of the alternate example embodiment of FIG. 8.

Figure 13:
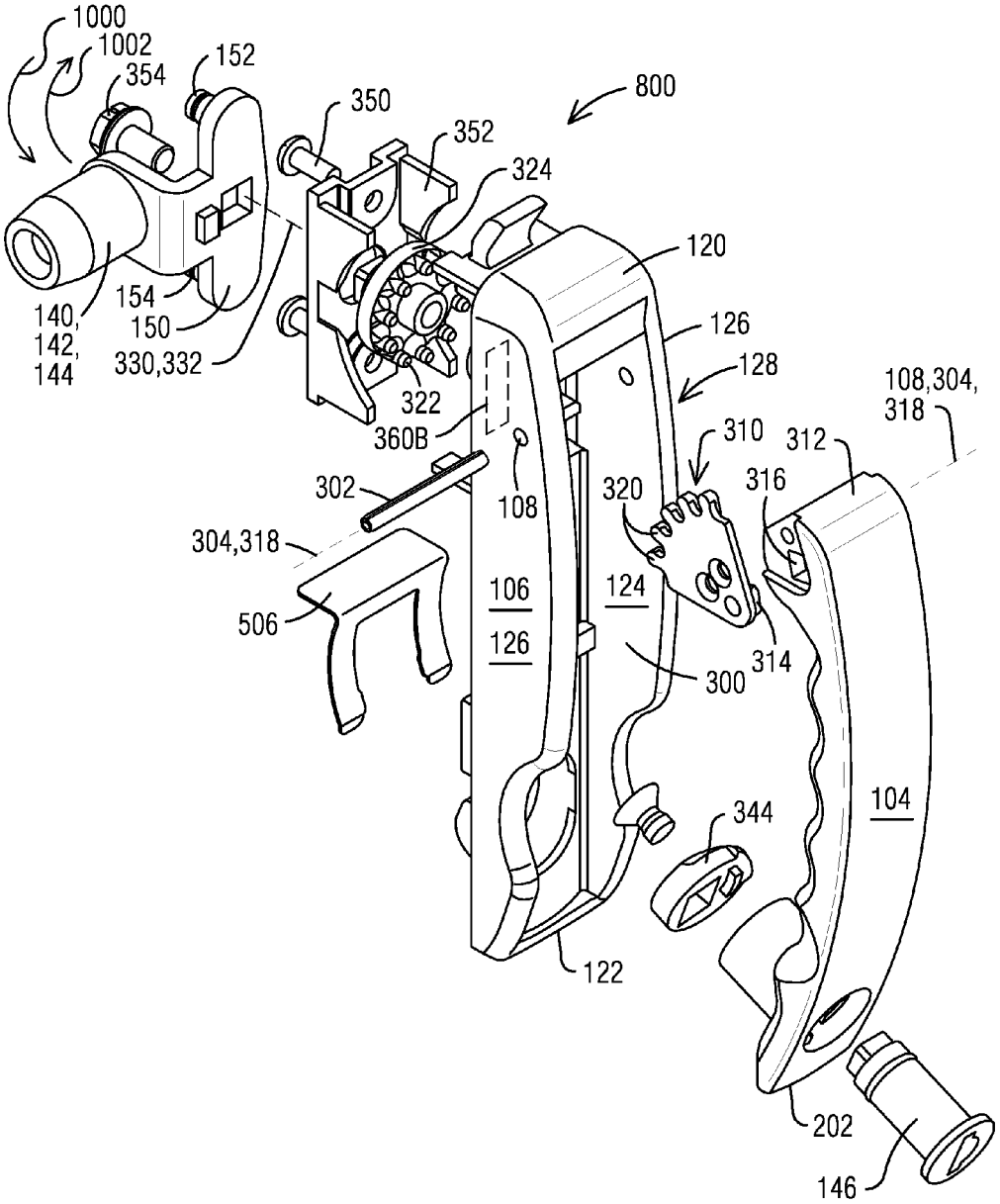
FIG. 13 shows an alternate assembly of the handle of FIG. 1.

FIG. 13 shows an alternate assembly of the handle 100. Components of the handle are reversible, meaning that they can be installed as shown in FIG. 3, or installed as shown in FIG. 10. These components include the main drive gear 310, and rotating structure 150 and its associated elements. As can be seen in FIG. 13, instead of being installed on the right side as is shown in FIG. 3, the main drive gear 310 can be installed on the left side of the handle (closer to the second side wall 126) and protrude through opening 360B.

Switching the main drive gear 310 to the left side changes the direction of rotation of the rotating mechanism 150 when the lever 104 is moved. When moving the lever 104 from the closed position 102 to the open position 206, the gear teeth 320 of the main drive gear 310 lower, thereby turning the cam gear 324 in a counter clockwise direction 1000. When moving the lever 104 from the open position 206 to the closed position 102, the gear teeth 320 of the main drive gear 310 raise, thereby turning the cam gear 324 in a clockwise direction 1002. This is the opposite of what happens when the main drive gear 310 is installed on the right side as shown in FIG. 3. This reversibility of the main drive gear 310 allows for the cam latch 140 to be pointed either up or down when the lever 104 is in the open position 206. Such versatility may be useful for situations where clearance for the cam latch 140 exists in one position but not the other. In addition, the rotating structure 150 may be flipped 180 degrees so that the cam latch 140 points to the left as in FIG. 13 instead of to the right as in FIG. 3. This provides the flexibility to accommodate handles positioned on the right side of a left-hinged door (FIG. 3) or the left side of a right-hinged door (FIG. 13).

From the foregoing it can be seen that the Inventors have devised a handle that enables unlocking and opening of a panel door using a single motion, and which likewise enables closing and locking of the panel door using another single, opposite motion. Accordingly, the handle represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A security handle assembly, comprising:

an escutcheon comprising a top end, a bottom end, a first side wall, a second side wall that is parallel to the first side wall, and a recessed area between the top and bottom ends and the first and second side walls;

a lever pivotally mounted toward the top end of the escutcheon and at least a portion of the lever is disposed within the recessed area when the lever is in a closed position;

a first gear operatively connected to a top side of the lever and a portion of the first gear including gear teeth extending through an opening in the escutcheon;

a second gear mounted on a back of the escutcheon and comprising cam teeth that mesh with the gear teeth of the first gear;

a cam latch operatively connected to the second gear to rotate when the second gear rotates and comprising at least one cam surface configured to abut a cam catch of a door frame when the lever is moved downward to the closed position and to release from the cam catch when the lever is moved upward to an open position; and, a lock mounted to a bottom end of the lever and configured to lock the lever to the escutcheon when the lever is in the closed position and the lock is in a locked position.

2. The security handle assembly of claim 1, wherein the lever rotates about a first axis of rotation and wherein the cam latch rotates about a second axis of rotation that is different than the first axis of rotation.

3. The security handle assembly of claim 2, wherein the first gear rotates about a third axis of rotation, the second gear rotates about a fourth axis of rotation, the first axis of rotation and the third axis of rotation are parallel to each other, and the second axis of rotation and the fourth axis of rotation are parallel to each other.

4. The security handle assembly of claim 3, wherein the first axis of rotation and the third axis of rotation are the same, and wherein the second axis of rotation and the fourth axis of rotation are the same.

5. The security handle assembly of claim 2, wherein lever rotation defines a first plane of rotation, cam latch rotation defines a second plane of rotation, and the first plane of rotation and the second plane of rotation are perpendicular to each other.

6. The security handle assembly of claim 1, wherein the lever is configured to receive the first gear on each of two sides, wherein when the first gear is secured to a first of the two sides rotation of the lever from the closed position rotates the second gear in one direction, and wherein when the first gear is secured to a second of the two sides rotation of the lever from the closed position rotates the second gear in a direction opposite the one direction.

7. The security handle assembly of claim 1, wherein the second gear rotates about a second gear axis of rotation and is configured to position the cam latch in either of two orientations, wherein a first orientation of the two orientations is 180 degrees from a second orientation of the two orientations about the second gear axis of rotation.

8. A security handle assembly, comprising:

an escutcheon comprising a top end, a bottom end, a first side wall, a second side wall that is parallel to the first side wall, and a recessed area between the top and bottom ends and the first and second side walls;

a lever pivotally mounted toward the top end of the escutcheon and rotation of which defines a first plane of rotation, wherein at least a portion of the lever is disposed within the recessed area when in a closed position;

a first gear operatively connected to a top end of the lever;

a second gear mounted on the back of the escutcheon and which engages the first gear; and a cam latch operatively connected to the second gear such that when the second gear rotates the cam latch rotates, wherein cam latch rotation defines a second plane of rotation that is different than the first plane of rotation, wherein when the lever is moved from the closed position to an open position the first gear, the second gear, and the cam latch rotate, thereby causing the cam latch to disengage from a door latch.

9. The security handle assembly of claim 8, further comprising a lock mounted to a bottom end of the lever and comprising a lock element that engages the escutcheon when the lever is in the closed position and the lock is in a locked position.

10. The security handle assembly of claim 8, wherein a majority of the lever fits in the recessed area.

11. The security handle assembly of claim 8, wherein the lever is mounted to the top end of the escutcheon such that when the lever is pivoted a bottom of the lever rotates out a front of the escutcheon.

12. The security handle assembly of claim 8, wherein the lever and the first gear both pivot about a lever pivot axis.

13. The security handle assembly of claim 12, wherein the first plane of rotation and the second plane of rotation form a 90 degree angle with each other.

14. The security handle assembly of claim 8, wherein the lever is configured to receive the first gear on each of two sides, wherein when the first gear is secured to a first of the two sides rotation of the lever from the closed position rotates the second gear in one direction, and wherein when the first gear is secured to a second of the two sides rotation of the lever from the closed position rotates the second gear in a direction opposite the one direction.

15. The security handle assembly of claim 8, wherein the second gear rotates about a second gear axis of rotation and is configured to position the cam latch in each of two orientations, wherein a first orientation of the two orientations is 180 degrees from a second orientation of the two orientations about the second gear axis of rotation.

16. A security handle assembly, comprising:

an escutcheon comprising a top end, a bottom end, a first side wall, a second side wall, and a recessed area between the top and bottom ends and the first and second side walls;

a lever pivotally mounted toward the top end of the escutcheon and at least a portion of the lever is disposed within the recessed area when in a closed position;

a first gear operatively connected to a top side of the lever and a portion of the first gear including gear teeth extending through an opening in the escutcheon;

a second gear mounted on a back of the escutcheon, oriented transverse to the first gear, and comprising cam teeth that mesh with the gear teeth of the first gear; and a cam latch operatively connected to the second gear to rotate when the second gear rotates;

wherein the lever is configured to receive the first gear on each of two sides, wherein when the first gear is secured to a first of the two sides rotation of the lever from the closed position rotates the second gear in one direction, and wherein when the first gear is secured to a second of the two sides rotation of the lever from the closed position rotates the second gear in a direction opposite the one direction.

17. The security handle assembly of claim 16, wherein the second gear rotates about a second gear axis of rotation and is configured to position the cam latch in each of two orientations, wherein a first orientation of the two orientations is 180 degrees from a second orientation of the two orientations about the second gear axis of rotation.

18. The security handle assembly of claim 16, further comprising a lock mounted to a bottom end of the lever and configured to lock the lever to the escutcheon when the lever is in the closed position and the lock is a locked position.

* * * * *